US011146009B2

(12) United States Patent
Li et al.

(10) Patent No.: US 11,146,009 B2
(45) Date of Patent: Oct. 12, 2021

(54) AUTOMATIC TERMINAL FITTING DEVICE FOR A FOUR-PIN ELECTRICAL CONNECTOR

(71) Applicant: DONGGUAN UNIVERSITY OF TECHNOLOGY, Dongguan (CN)

(72) Inventors: Chuan Li, Dongguan (CN); Yun Bai, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 130 days.

(21) Appl. No.: 16/399,645

(22) Filed: Apr. 30, 2019

(65) Prior Publication Data

US 2019/0341713 A1 Nov. 7, 2019

(51) Int. Cl.
*H01R 13/405* (2006.01)

(52) U.S. Cl.
CPC ..... *H01R 13/405* (2013.01)

(58) Field of Classification Search
CPC ..... H01R 13/405
See application file for complete search history.

(56) References Cited

FOREIGN PATENT DOCUMENTS

CN 201383620 Y * 1/2010
CN 107553085 A * 1/2018

* cited by examiner

*Primary Examiner* — Carl J Arbes
(74) *Attorney, Agent, or Firm* — Law Offices of Steven W. Weinrieb

(57) ABSTRACT

The present invention relates to an automatic terminal fitting device for four-pin electrical connector which may comprise a rack, power control box and conveying device provided on the rack. A rubber shell vibration disc, a terminal fitting mechanism, and a back cover vibration disc are provided on the rack along the transporting direction. The rubber shell vibration disc is connected to the front end of the conveying device by a rubber shell transportation rail. The terminal fitting mechanism is provided on the back side of the conveying device and engages with the terminal feeding device provided on the rack. The back cover vibration disc is provided on the back side of the conveying device, to the right side of the terminal fitting mechanism. And the terminal fitting mechanism may include four sets of terminal fitting devices sequentially provided on the back side of the conveying device. On the right side of the terminal fitting devices, a terminal strip bending device engaging with the conveying device is provided. The present invention effectively addresses the problems existing when fitting terminals manually during assembly, such as low production efficiency, high manpower consumption, intensive labor investment, relatively high potential safety hazard occurrence, and unsatisfactory connector defect rate.

6 Claims, 7 Drawing Sheets

AUTOMATIC TERMINAL FITTING DEVICE FOR A FOUR-PIN ELECTRICAL CONNECTOR

FIELD OF THE INVENTION

The present invention relates to assembly technology of electrical connectors, and more especially discloses an automatic terminal fitting device for a four-pin electrical connector.

BACKGROUND OF THE INVENTION

Existing four-pin electrical connector product, generally comprise three main parts, namely, a rubber shell 23, a terminal 38, and a back cover 64, and in this regard, the correct assembly of the electrical connector components of the rubber shell 23, the terminal 38 and the back cover 64 according to their mutual relationship. At present, electrical connector assembly is done manually or semi-automatically, which involves complex working procedures, and due to large amount of manual work, some problems such as low production efficiency, high manpower consumption, intensive labor investment, relatively high safety hazard potentials and undesirable product deficiency rate etc. are detected.

SUMMARY OF THE INVENTION

The present invention relates to an automatic terminal fitting device for a four-pin electrical connector, solving the present problems which may happen in the assembly process, such as low production efficiency because of manual operation, high consumption of human resources, high labor intensity of workers, high risk of relative safety and high defective rate of electrical connectors. In order to achieve the above purposes, the technical scheme adopted by the present invention is as follows:

The automatic terminal fitting device for four-pin electrical connector comprises a rack, a power control box and a conveying device which is provided on the rack; on the rack, a rubber shell vibration disc, a terminal fitting mechanism, a back cover vibration disc are provided along the transport direction; the rubber shell vibration disc is connected to the front side of the conveying device by a rubber shell transport rail; the terminal fitting mechanism is provided on the back side of the conveying device and engages with the terminal feeding device provided on the rack; the back cover vibration disc is provided on the rear side of the conveying device and located on the right side of the terminal fitting mechanism; the terminal fitting mechanism may include four terminal fitting devices sequentially provided on the back side of the conveying device; on the right side of the terminal fitting devices, a terminal strip bending device fitting the conveying device is provided; on the right side of the terminal strip bending device is provided a riveting device engaging the conveying device and on the right side of the riveting device is provided a back cover assembly device.

Furthermore, the conveying device may include a rail support which is provided on the rack; above the rail support is provided a rubber shell conveying track and a screw shaft is provided on the rail support along the transportation direction; on the rail support and above the screw shaft is provided a photoelectric support; on the photoelectric support are evenly provided three photoelectric sensors; the right end of the screw shaft is connected to the output shaft of the second motor provided on the rack; a positioning block fitting the screw shaft by screw threads is provided thereon; on top of the positioning block is provided a shading sheet fitting the photoelectric sensors; and to the rear side of the positioning block is connected a material feeding guiding bar slidably cooperating with the rail support; on the said material feeding guiding bar, a stirring pole seat is provided; and on the stirring pole seat are evenly provided several material stirring poles; the material stirring poles fit the rubber shells provided on the rubber shell conveying track; on the said rubber shell conveying track, material holding switches fitting the rubber shells is provided; both the photoelectric sensors and the second motor are electrically connected to the power control box.

Furthermore, the terminal feeding device may include a terminal feeding rack, a terminal strip disc, a terminal transportation rail, a first motor, and a guide pulley; the terminal strip disc is provided on the said terminal feeding rack; and the output end of the first motor is engages with the center of the terminal strip disc; the terminal transportation rail is provided below the terminal strip disc and on the terminal transportation rail is provided a guide pulley fitting the material tape; the first motor is electrically connected to the power control box.

Furthermore, the terminal assembly mechanism comprises a lower seat, a first rotating shaft, a terminal fitting base, a first pushing plate, a first cylinder, a terminal compacting block, a second rotating shaft, an upper seat, a supporting plate, and connection joint; on the rear side of the rubber shell conveying track, a terminal fitting base is provided on the rack; on the said terminal fitting base is provided the first cylinder whose output shaft is connected to the first pushing plate through the connection joint; a pin which plugs and fits the supporting plate is provided thereon and the pin fits the supporting hole provided in the center of the first pushing plate; the upper seat movably matches the upper gripping slot provided on the first pushing plate by the second rotating shaft; and the lower seat movably matches the lower gripping slot provided on the first pushing plate by the first rotating shaft; on the upper seat and the lower seat are respectively provided an upper gripper and a lower gripper; to the front side of the upper gripper is provided a material cutting blade and to the front end of the lower gripper is provided a terminal lower mold matching the material cutting blade; a terminal compacting block is provided on the left side and above the upper seat; the terminal compacting block fits the terminal strip which is located in the discharging portion of the terminal transportation rail; the first cylinder is electrically connected to the power control box.

Furthermore, the material bending tape device comprises a terminal strip bending seat, a reject bin, a material bending head, a material bending fixing block, a second pushing plate, a second cylinder, a lifting seat, and a third rotating shaft; on the terminal strip bending seat is provided the second cylinder whose output shaft is connected to the second pushing plate; the second pushing plate cooperates with the material bending fixing block provided on the terminal strip bending seat by plugging and fitting; and on the second pushing plate is provided a wave shaped bending slot inside which is fitted the third rotating shaft, the third rotating shaft is fixed to the lifting seat vertically provided on the material bending fixing block, the lifting seat slidably cooperates with the material bending fixing block and on the said lifting seat is provided a material bending head; in the front end of the material bending head is provided a material gripping tooth; on the bottom of the material bending head and at rear side of the material gripping tooth is provided a discharging hole; and the discharging hole is connected to the reject bin provided on the rack and the second cylinder is electrically connected to the power control.

Furthermore, the riveting device comprises a riveting seat, a third pushing plate, a third cylinder, a riveting head, and a guiding seat, which are provided on the rack; on the riveting seat is provided the third cylinder whose output shaft is connected to the third pushing plate; the third pushing plate slidably cooperates with the guiding seat provided on the riveting seat by plugging and fitting; and to the front end of the third pushing plate is connected the riveting head fitting the four sets of terminals in the rubber shell; the third cylinder is electrically connected to the power control box.

Furthermore, the back cover assembly device comprises an back cover assembly seat, the fourth pushing plate, a back cover conveying rail, a back cover distribution block, a baffle, a fourth cylinder and the fifth cylinder; on the back cover assembly seat is provided the fifth cylinder whose output shaft is connected to the fourth pushing plate; the fourth pushing plate slidably cooperates with the back cover material distribution slot on the back cover distribution block (61); to the right side of the back cover distribution block the back cover conveying rail cooperating with the back cover vibration disc is connected; below the back cover distribution block and on the back cover assembly seat is provided the fourth cylinder whose output shaft is connected the baffle which cooperates with the back cover distribution block by plugging and fitting; both the fourth cylinder and the fifth cylinder are electrically connected to the power control box.

The beneficial effects of the present invention are shown as follows:

The present invention may the problems which may happen in the assembly process, such as low production efficiency because of manual operation, high consumption of human resources, high labor intensity of workers, high risk of relative safety and high defective rate of electrical connectors.

As a result of the structure of the conveying device, by rotating the screw shaft with the second motor, it is possible to move the positioning block, in the meantime, realize precise positioning with the three sets of photoelectric sensor together with the shading sheet, which improves accuracy of rubber shell conveying and positioning.

In addition, as a result of the terminal feeding device with a guide pulley, it is possible to keep the terminal strip going smoothly, and avoid jam due to vibration.

Similarly, as a result of the structure of the terminal assembly mechanism, the first cylinder pushes the first pushing plate forward to have the second rotating shaft slide along the upper gripping slot, driving the upper seat to move up and down in reciprocating motion; at the same time, by making the first rotating shaft slide along the lower gripping slot drives the lower seat to move up and down in reciprocating motion, which achieves both material gripping and terminal pushing sophisticatedly.

Still further, with respect to the terminal strip bending device, the second cylinder pushes the second pushing plate to make the third rotating shaft travel against the wave shaped bending slot, therefore the lifting seat moves up and down in reciprocating motion. At the same time, the material gripping tooth in the front end of the material bending head clamps the waste strip to bend, which is sophisticatedly designed and easy to operate.

Yet further, with the structure of the riveting device, the third cylinder pushes the third pushing plate, and the riveting head compacts the four sets of terminals, preventing deficiency resulting from unstable connection due to unevenly distributed terminals and promising product quality.

In addition, as a result of the structure of the back cover assembly device, by moving the fourth pushing plate with the fifth cylinder, moving baffle with the fourth cylinder and cooperating with the back cover conveying track, assembly of the back cover can be completed automatically, which is of high efficiency.

REFERENCE NUMBERS OF COMPONENTS

All various elements in the FIGURES are shown as follows:

1. rack,
2. conveying device,
3. rubber shell vibration disc,
4. terminal feeding device,
5. back cover vibration disc,
6. guide pulley,
7. terminal transportation rail,
8. terminal strip disc,
9. the first motor,
10. Terminal feeding rack,
11. rail support,
12. photoelectric support,
13. shading sheet,
14. photoelectric sensor,
15. positioning block,
16. screw shaft,
17. the second motor,
18. rubber shell conveying track,
19. material feeding guiding bar,
20. stirring pole seat,
21. material stirring pole,
22. material holding switch,
23. rubber shell,
24. lower seat,
25. the first rotating shaft,
26. terminal fitting base,

27. the first pushing plate,
28. the first cylinder,
29. terminal compacting block,
30. the second rotating shaft,
31. upper seat,
32. supporting plate,
33. connection joint,
34. material cutting blade,
35. upper gripper,
36. lower gripper,
37. terminal lower mold,
38. terminal,
39. terminal strip bending seat,
40. reject bin,
41. material bending head,
42. material bending fixing block,
43. the second pushing plate,
44. the second cylinder,
45. lifting seat,
46. the third rotating shaft,
47. material bending slot,
48. discharging hole,
49. material gripping tooth,
50. riveting seat,
51. the third pushing plate,
52. the third cylinder,
53. riveting head,
54. guiding seat,
55. upper gripping slot,
56. lower gripping slot,
57. supporting hole,
58. back cover assembly seat,
59. the fourth pushing plate,
60. back cover conveying rail,
61. back cover distribution block,
62. baffle,
63. the fourth cylinder,
64. back cover,
65. the fifth cylinder,
66. terminal strip.

DETAILED DESCRIPTION OF THE ILLUSTRATED EMBODIMENT

In order to enable a person skilled in the art to better understand the technical scheme of the present invention, the following description may be given to the present invention in detail with reference to the accompanying drawings. The description of the invention is merely exemplary and explanatory and should not limit the scope of the protection scope of the present invention.

Figure 1:
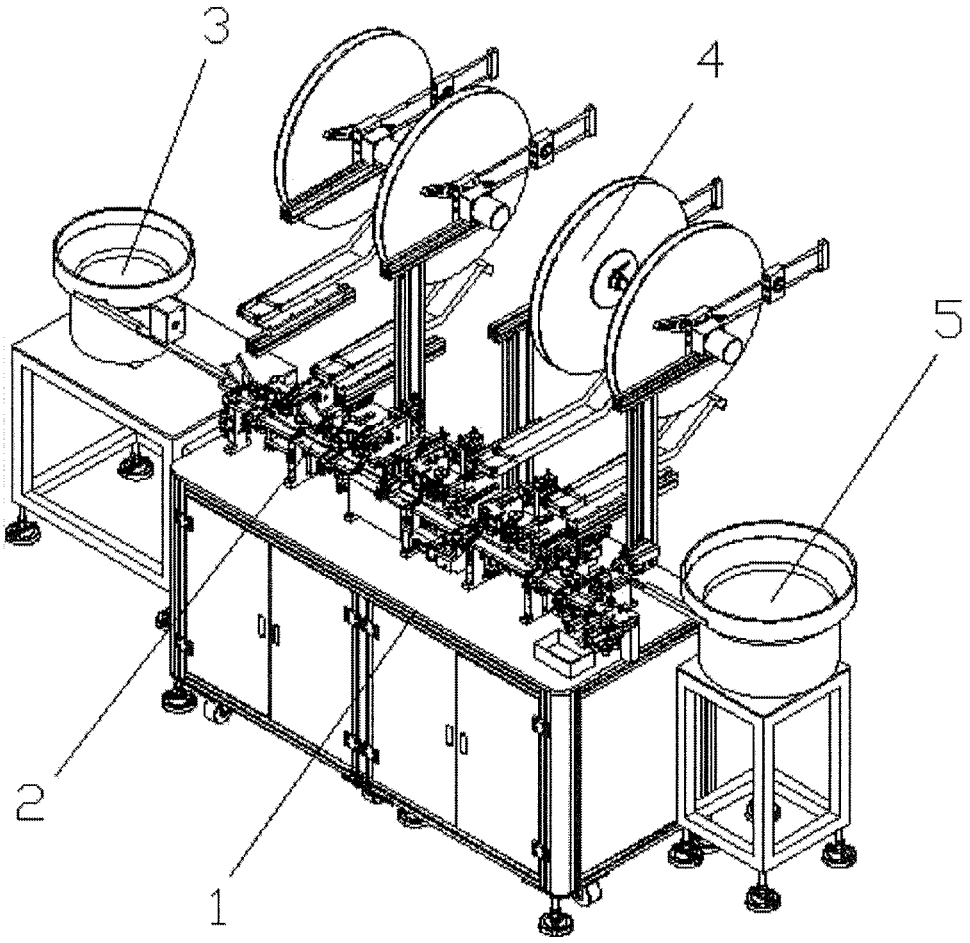
FIG. 1 shows the structural view of the automatic terminal fitting device for a four-pin electrical connector.
Figure 2:
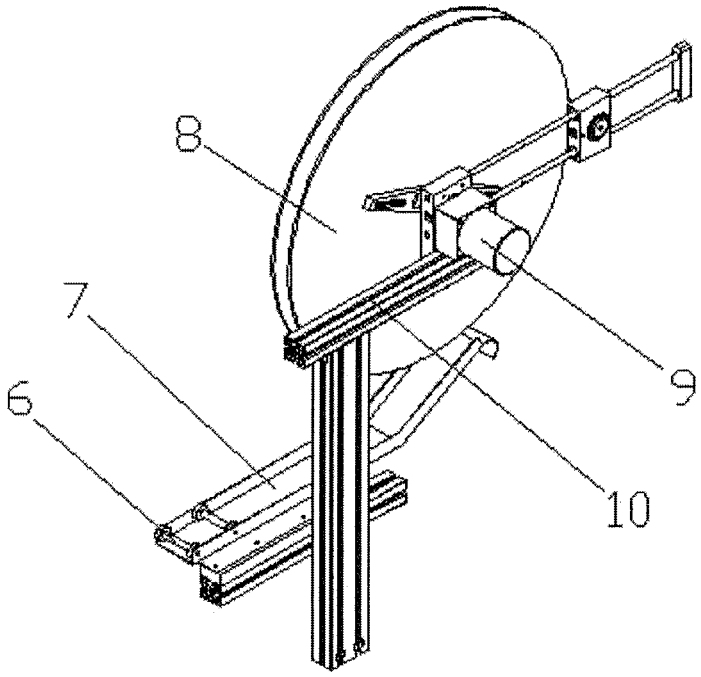
FIG. 2 shows the structural view of the terminal feeding device.
Figure 3:
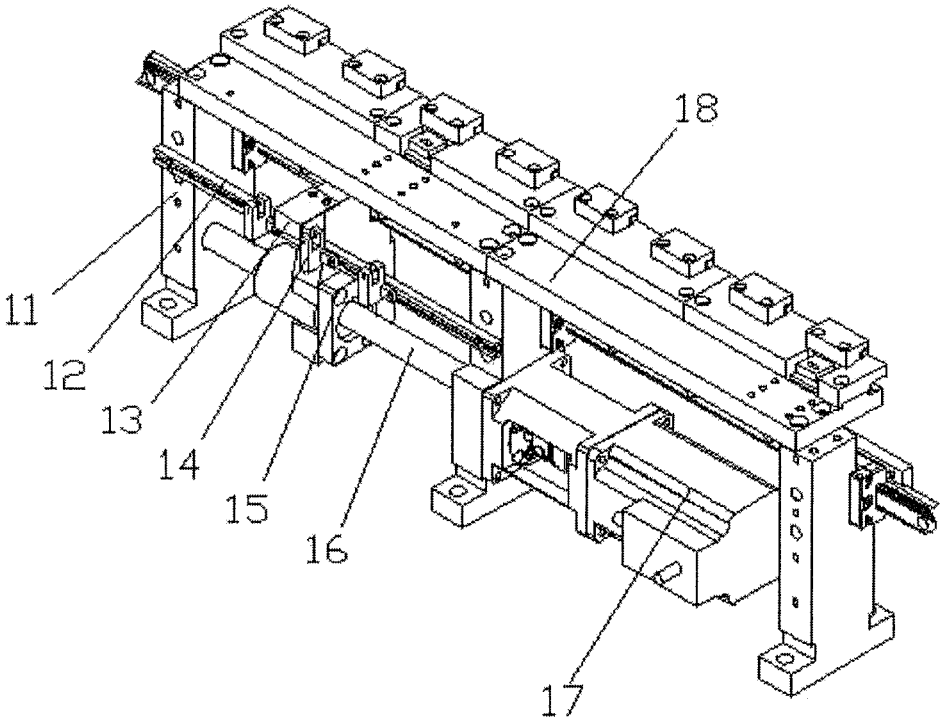
FIG. 3 shows the structural view of the conveying device.
Figure 4:
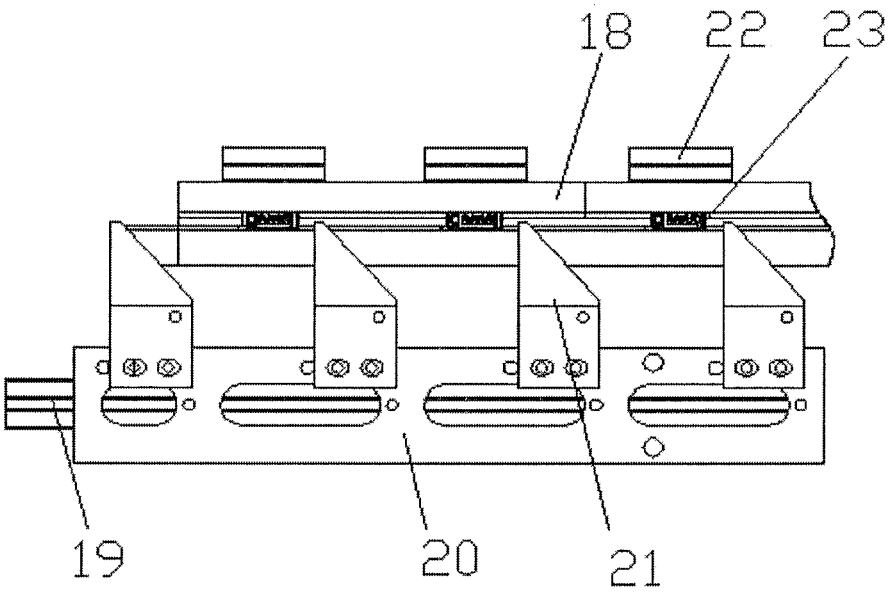
FIG. 4 shows the structural view of the material stirring pole in FIG. 3.
Figure 5:
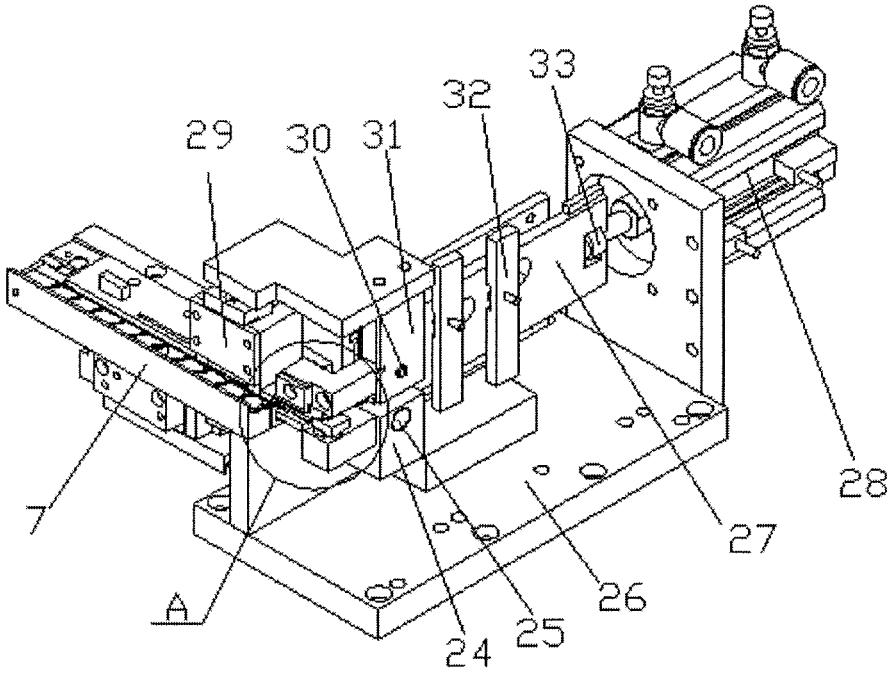
FIG. 5 shows the structural view of the terminal fitting devices.
Figure 6:
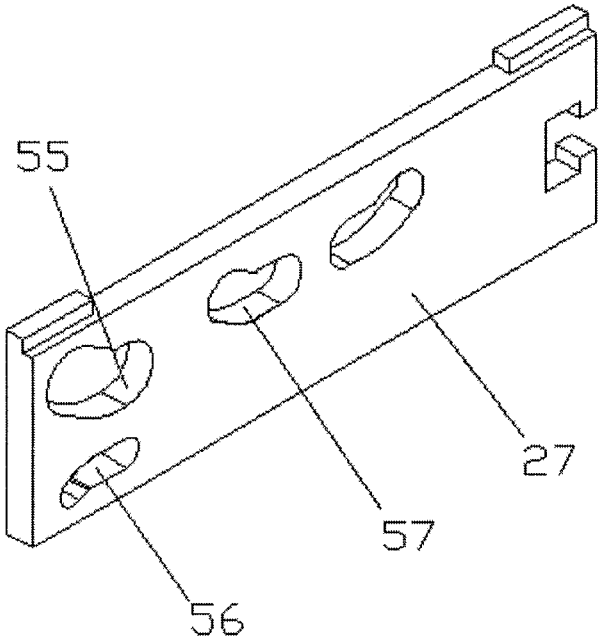
FIG. 6 shows the structural view of the first pushing plate in FIG. 5.
Figure 7:
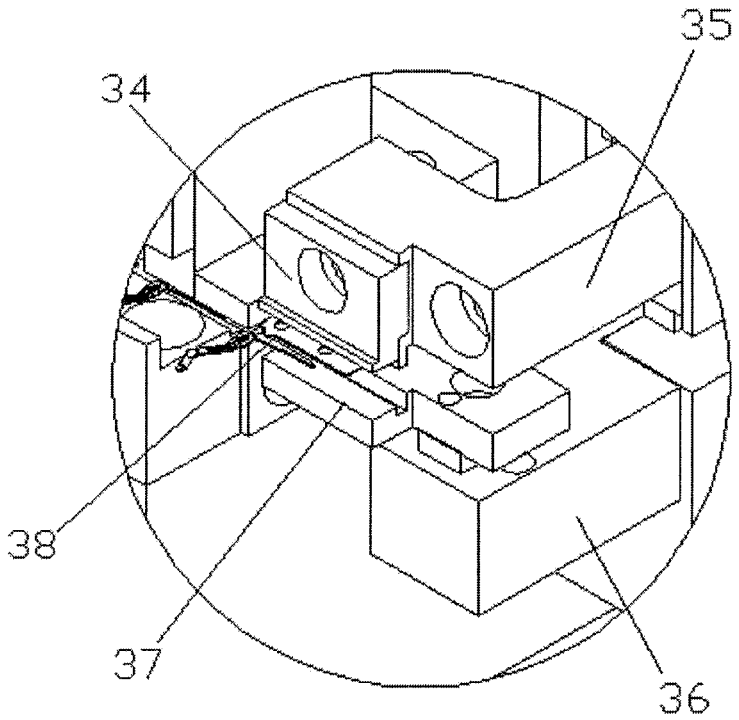
FIG. 7 shows an enlarged view of part A in FIG. 5.
Figure 8:
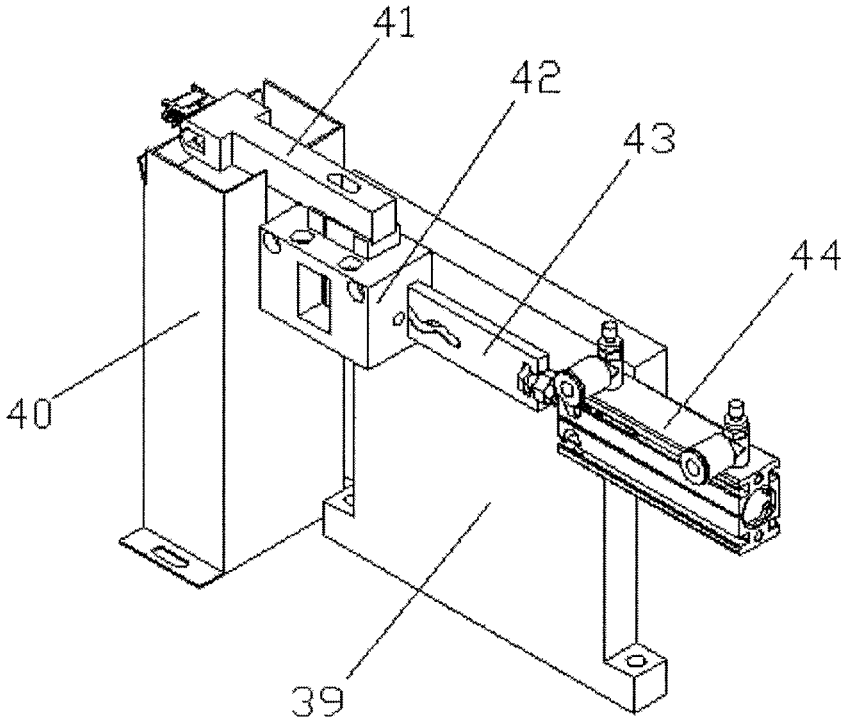
FIG. 8 shows the structural view of the terminal strip bending device.
Figure 9:
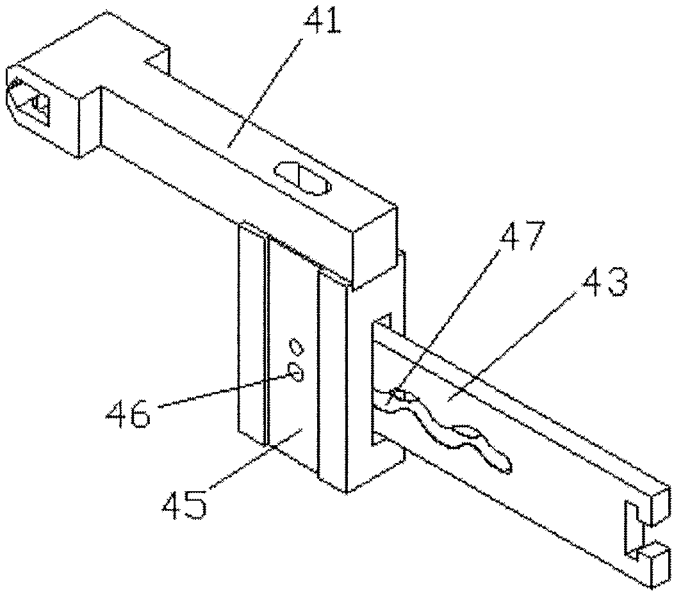
FIG. 9 shows the structural view of the second pushing plate in FIG. 8 engaging with the lifting seat.
Figure 10:
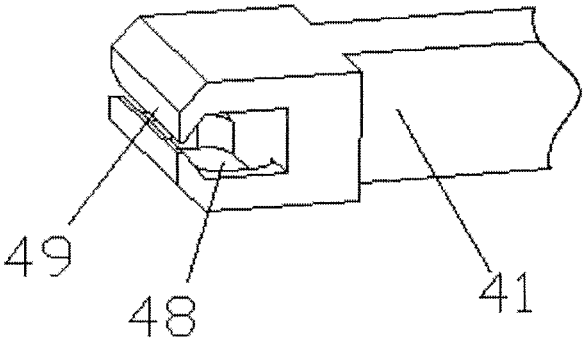
FIG. 10 shows the structural view of the front end of terminal strip bending head in FIG. 9.
Figure 11:
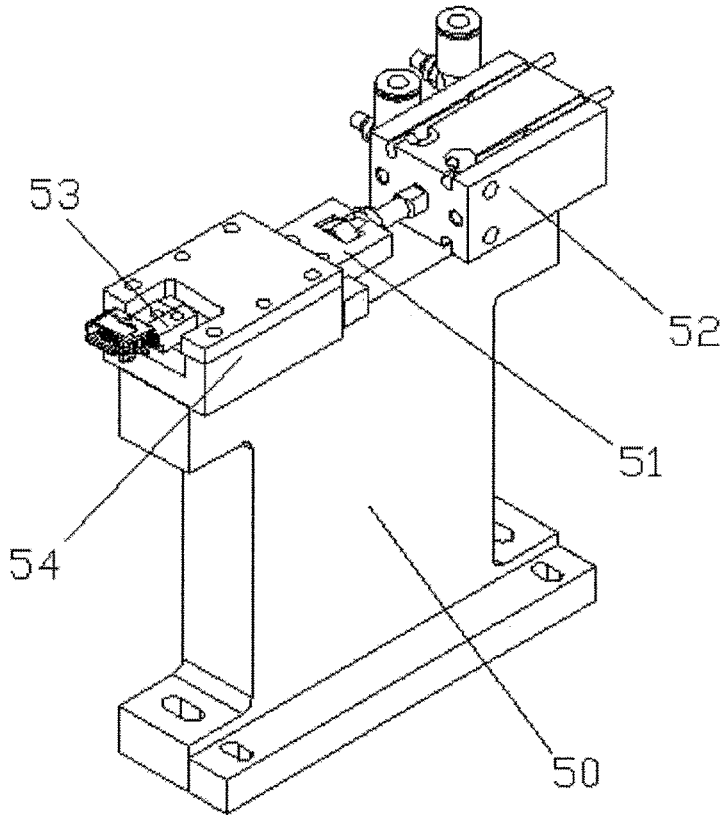
FIG. 11 shows the structural view of the riveting device.
Figure 12:
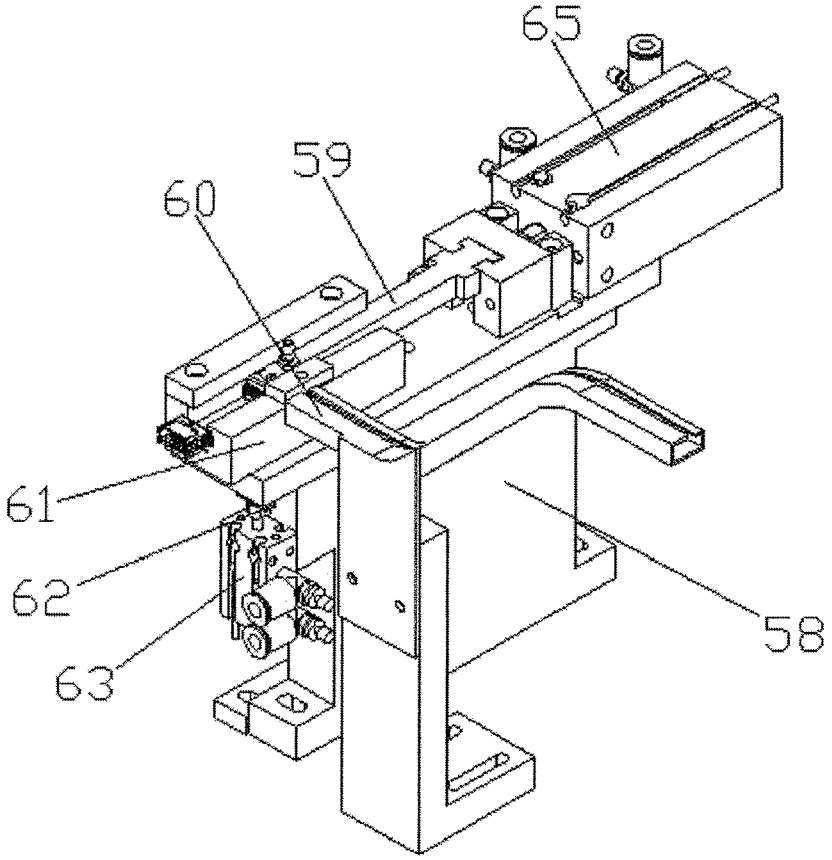
FIG. 12 shows the structural view of the back cover fitting device.
Figure 13:
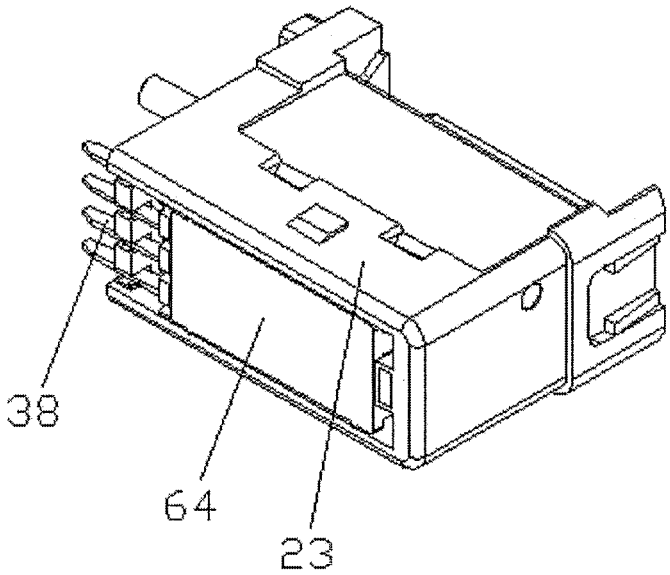
FIG. 13 shows the structural view of the four-pin electric connector product.
Figure 14:
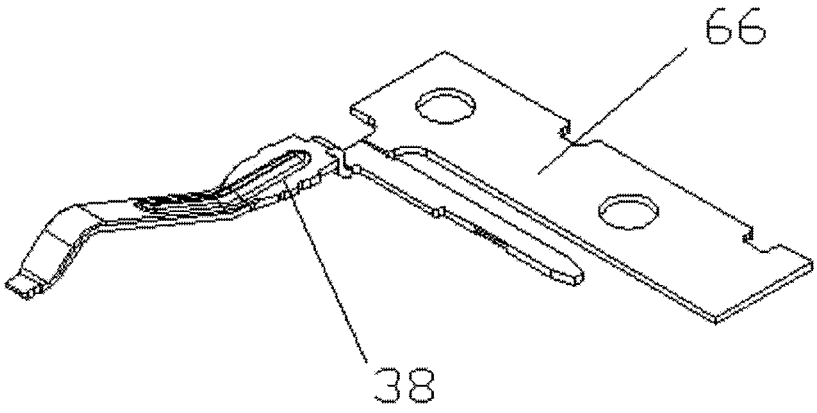
FIG. 14 shows the structural of the terminal.

As it shown in FIGS. 1-14, the structure of the invention is shown as follows:

an automatic terminal fitting device for four-pin electrical connector comprises a rack 1, a power control box and a conveying device 2 which is provided on the rack 1; on the said rack 1, a rubber shell vibration disc 3, a terminal fitting mechanism, a back cover vibration disc 5 are provided along the transport direction; the rubber shell vibration disc 3 is connected to the front side of the conveying device 2 by a rubber shell transport rail; the terminal fitting mechanism 2 is provided on the back side of the conveying device and engages with the terminal feeding device 4 provided on the rack 1; the back cover vibration disc 5 is provided on the rear side of the conveying device and located on the right side of the terminal fitting mechanism; the terminal fitting mechanism may include four terminal fitting devices sequentially provided on the back side of the conveying device 2; on the right side of the terminal fitting devices, a terminal strip bending device fitting the conveying device 2 is provided; on the right side of the terminal strip bending device is provided a riveting device engaging the conveying device 2 and on the right side of the riveting device is provided a back cover assembly device.

Preferably, the conveying device 2 comprises a rail support 11 which is provided on the rack 1; above the rail support 11 is provided a rubber shell conveying track 18 and a screw shaft 16 is provided on the rail support 11 along the transportation direction; on the rail support 11 and above the screw shaft 16 is provided a photoelectric support 12; on the photoelectric support 12 are evenly provided three photoelectric sensors 14; the right end of the screw shaft 16 is connected to the output shaft of the second motor 17 provided on the rack 1; a positioning block 15 fitting the screw shaft by screw threads 16 is provided thereon; on top of the positioning block 15 is provided a shading sheet 13 fitting the photoelectric sensors 14; and to the rear side of the positioning block 15 is connected a material feeding guiding bar 19 slidably cooperating with the rail support 11; on the said material feeding guiding bar 19, a stirring pole seat 20 is provided; and on the stirring pole seat 20 are evenly provided several material stirring poles 21; the material stirring poles 21 fit the rubber shells 23 provided on the rubber shell conveying track 18; on the said rubber shell conveying track 18, material holding switches 22 fitting the rubber shells 23 is provided; both the photoelectric sensors 14 and the second motor 17 are electrically connected to the power control box.

Preferably, the terminal feeding device 4 comprises a terminal feeding rack 10, a terminal strip disc 8, a terminal transportation rail 7, a first motor 9, and a guide pulley 6; the terminal strip disc 8 is provided on the said terminal feeding rack 10; and the output end of the first motor 9 is engages with the center of the terminal strip disc 8; the terminal transportation rail 7 is provided below the terminal strip disc 8 and on the terminal transportation rail 7 is provided a guide pulley 6 fitting the material tape; the first motor 9 is electrically connected to the power control box.

Preferably, the terminal assembly mechanism comprises a lower seat 24, a first rotating shaft 25, a terminal fitting base 26, a first pushing plate 27, a first cylinder 28, a terminal compacting block 29, a second rotating shaft 30, an upper seat 31, a supporting plate 32, and connection joint 33; on the rear side of the rubber shell conveying track 18, a terminal fitting base 26 is provided on the rack 1; on the said terminal fitting base 26 is provided the first cylinder 28 whose output shaft is connected to the first pushing plate 27 through the connection joint 33; a pin which plugs and fits the supporting plate 32 is provided thereon and the pin fits the supporting hole 57 provided in the center of the first pushing plate 27; the upper seat 31 movably matches the upper gripping slot 55 provided on the first pushing plate 27 by the second rotating shaft 30; and the lower seat 24 movably matches the lower gripping slot 56 provided on the first pushing plate 27 by the first rotating shaft 25; on the upper seat 31 and the lower seat 24 are respectively provided an upper gripper 35 and a lower gripper 36; to the front side of the upper gripper 35 is provided a material cutting blade and to the front end of the lower gripper 36 is provided a terminal lower mold 37 matching the material cutting blade 34; a terminal compacting block 29 is provided on the left side and above the upper seat 31; the terminal compacting block 29 fits the terminal strip which is located in the discharging portion of the terminal transportation rail 7; the first cylinder 28 is electrically connected to the power control box.

Preferably, the material bending tape device comprises a terminal strip bending seat 39, a reject bin 40, a material bending head 41, a material bending fixing block 42, a second pushing plate 43, a second cylinder 44, a lifting seat 45, and a third rotating shaft 46; on the terminal strip bending seat 39 is provided the second cylinder 44 whose output shaft is connected to the second pushing plate 43; the second pushing plate 43 cooperates with the material bending fixing block 42 provided on the terminal strip bending seat 39 by plugging and fitting; and on the second pushing plate 43 is provided a wave shaped bending slot 47 inside which is fitted the third rotating shaft 46, the third rotating shaft 46 is fixed to the lifting seat 45 vertically provided on the material bending fixing block 42, the lifting seat 45 slidably cooperates with the material bending fixing block 42 and on the said lifting seat 45 is provided a material bending head 41; in the front end of the material bending head 41 is provided a material gripping tooth 49; on the bottom of the material bending head 41 and at rear side of the material gripping tooth 49 is provided a discharging hole 48; and the discharging hole 48 is connected to the reject bin 40 provided on the rack 1 and the second cylinder 44 is electrically connected to the power control.

Preferably, the riveting device comprises a riveting seat 50, a third pushing plate 51, a third cylinder 52, a riveting head 53, and a guiding seat 54, which are provided on the rack 1; on the riveting seat 50 is provided the third cylinder 52 whose output shaft is connected to the third pushing plate 51; the third pushing plate 51 slidably cooperates with the guiding seat 54 provided on the riveting seat 50 by plugging and fitting; and to the front end of the third pushing plate 51 is connected the riveting head 53 fitting the four sets of terminals in the rubber shell; the third cylinder 52 is electrically connected to the power control box.

Preferably, the back cover assembly device comprises an back cover assembly seat 58, the fourth pushing plate 59, a back cover conveying rail 60, a back cover distribution block 61, a baffle 62, a fourth cylinder 63 and the fifth cylinder 65; on the back cover assembly seat 58 is provided the fifth cylinder 65 whose output shaft is connected to the fourth pushing plate 59; the fourth pushing plate 59 slidably cooperates with the back cover material distribution slot on the back cover distribution block 61; to the right side of the back cover distribution block 61 the back cover conveying rail 60 cooperating with the back cover vibration disc 5 is connected; below the back cover distribution block 61 and on the back cover assembly seat 58 is provided the fourth cylinder 63 whose output shaft is connected the baffle 62 which cooperates with the back cover distribution block 61 by plugging and fitting; both the fourth cylinder 63 and the fifth cylinder 65 are electrically connected to the power control box.

During use, and after turning on the device, the working procedures of the automatic terminal fitting device are shown as follows:

Terminal feeding process: turn the terminal strip disc 8 with the first motor 9, at the same time the terminal strip 66 passes under of the guide pulley 6, which may keep the terminal strip running smoothly in the terminal transportation rail 7 and prevent jam caused by dithering of the material tape.

Rubber shell transport process: the second motor 17 may turn the screw shaft 16 to move the positioning block 15. The engagement of the positioning block 15 and the material feeding guiding bar 19 drives the stirring pole seat 20 to move left and right in reciprocating motion. The material stirring pole 21 may move the rubber shells 23 and the material holding switch 22 may hold the rubber shells 23 in place. At the same time, the three sets of the photoelectric sensors may cooperate with the shading sheet 13 to ensure the accurate positioning of rubber shells.

Terminal assembly: the first motor 28 may push the first pushing plate 27 forward and slide the second rotating shaft 30 along the curved upper gripping slot 55 to have the upper seat 31 move up and down in reciprocating movement. At the same time, the first rotating shaft 25 may slide along the curved lower gripping slot 56 to make the lower seat move up and down in reciprocating movement. In this manner the upper gripper 35 and the lower gripper 36 can move forward and open and shut in the same time, to grip material and move along to fit the terminal into the rubber shell, which is sophisticatedly designed.

Terminal strip bending: the second motor 44 may push the second pushing plate forward and the third rotating shaft 46 may slide along the wave shaped material bending slot 47, consequently, the lifting seat 45 may move up and down in reciprocating movement in the material bending fixing block 42. At the same time the material gripping tooth 49 on the front end of the material bending head 41 may clamp the waste strip to bend and complete material bending process, which is delicately designed and easy to operate.

Terminal riveting process: the second cylinder 52 may push the third pushing plate 51 forward and the riveting head 53 may rivet and press the four sets of terminals to prevent the contact problems of the electric connector because of the uneven terminal position to ensure the quality of the product.

Back cover assembly: the fifth cylinder 65 may push the fourth pushing plate 59 forward and the fourth cylinder 63 may push the baffle 62 up and down to finish back cover feeding process with the baffle 62 and the back cover conveying track 60. And the fourth cylinder 59 may push the back cover into the rubber shell to finish the assembly process of the back cover with high efficiency.

It should be noted that the term "include" is used herein, "including" or any other variants thereof intended to encompass a non-exclusive inclusion, such that a process comprising a series of elements is included, the method, the article or the device not only comprise those elements but also include other elements not explicitly listed, or further includes the inherent elements of the process, the method, the article or the equipment.

The principles and implementation mode of the invention are set forth in the specification. The description of the above examples is only used for helping understand the method of the invention and the core idea of the method. The above descriptions are only preferred embodiments of the present invention and it should be noted that due to the limitation of character expression, an infinite specific structure exists objectively. For persons of ordinary skill in the art, without departing from the principle of the present invention, a plurality of improvements, modifications and changes can be made. The technical features can also be combined in a proper manner. The conception and the technical scheme of the invention can be directly applied to other occasions without improving the conception and the technical scheme of the invention, which can be regarded as the protection scope of the invention.

What is claimed and desired to be protected by Letters Patent is:

1. An automatic terminal fitting device for fitting a terminal into a four-pin electrical connector comprising:

a rack;

a power control box;

a conveying device disposed upon said rack, movable in a transport direction, and having a first end and a second end;

a rubber shell vibration disc disposed adjacent to said first end of said conveying device;

a plurality of terminal fitting mechanisms mounted upon said conveying device;

a back cover vibration disc disposed adjacent to said second end of said conveying device;

wherein said rubber shell vibration disc is connected to said first end of said conveying device by a rubber shell transport rail;

a plurality of terminal feeding devices mounted upon said rack;

a first motor for rotating said plurality of terminal feeding devices;

said terminal fitting mechanisms are mounted upon said conveying device so as to engage said plurality of terminal feeding devices mounted upon said rack;

said back cover vibration disc is disposed adjacent to a last one of said plurality of terminal fitting mechanisms as considered in said transport direction of said conveying device;

said terminal fitting mechanisms comprise four terminal fitting mechanisms sequentially disposed along said conveying device as considered in said transport direction of said conveying device;

a terminal strip bending device is disposed downstream of said conveying device as considered in said transport direction of said conveying device;

a riveting device is disposed downstream of said terminal strip bending device as considered in said transport direction of said conveying device;

a back cover assembly device is disposed downstream of said riveting device as considered in said transport direction of said conveying device; and a terminal assembly mechanism for forming a terminal strip into a terminal and which comprises:

a lower seat;

a first rotating shaft mounted within said lower seat;

a terminal fitting base mounted upon said rack and upon which said lower seat is mounted;

a first pushing plate;

a first cylinder operatively connected to said first pushing plate;

a terminal compacting block mounted upon said terminal fitting base;

a supporting plate upon which said first pushing plate is mounted;

an upper seat connected to said terminal compacting block;

a second rotating shaft mounted within said upper seat;

a connection joint defined between first pushing plate and said first cylinder;

a rail support mounted upon said rack;

a rubber shell conveying track is mounted atop said rail support;

a terminal fitting base, upon which said lower seat is mounted, is mounted upon said rack;

a pin is mounted upon said supporting plate and is adapted to be disposed within a supporting hole defined within said first pushing plate;

said second rotating shaft, mounted upon said upper seat, is adapted to be disposed within an upper gripping slot defined within said first pushing plate ]] second rotating;

said first rotating shaft, mounted upon said lower seat, is adapted to be disposed within a lower gripping slot which is also defined within said first pushing plate at a position beneath said upper gripping slot;

an upper gripper and a lower gripper are respectively mounted upon said upper seat and said lower seat;

a material cutting blade is mounted upon one side of said upper gripper and a lower terminal mold is mounted upon one side of said lower gripper (36) so as to be disposed beneath said material cutting blade;

a terminal transportation rail having a discharging portion disposed beneath said terminal compacting block such that said terminal compacting block can fit a terminal, formed from said terminal strip, into a four-pin electrical connector; and wherein said first cylinder is electrically connected to said power control box.

2. The automatic terminal fitting device for a four-pin electrical connector as set forth in claim 1, wherein:

a screw shaft is provided upon said rail support along said transportation direction;

a photoelectric support is mounted upon said rail support above said screw shaft;

a plurality of equally spaced photoelectric sensors are mounted upon said photoelectric support;

a second motor is operatively connected to one end of said screw shaft and is mounted upon said rail support;

a positioning block is mounted upon said screw shaft such that said positioning block threadedly cooperates with screw threads defined upon said screw shaft;

a shading sheet is disposed atop said positioning block and is adapted to operatively cooperate with said plurality of photoelectric sensors a material feeding guide bar slidably cooperates, with said rail support and a stirring pole seat;

a plurality of material stirring poles are equidistantly mounted upon said stirring pole seat;

a plurality of rubber shells are disposed upon said rubber shell conveying track by said plurality of material stirring poles;

a plurality of material holding switches are mounted upon said rubber shell conveying track and cooperate with said plurality of material stirring poles so as to retain said rubber shells at predetermined positions upon said rubber shell conveying track; and both said plurality of photoelectric sensors and said second motor are electrically connected to said power control box.

3. The automatic terminal fitting device fora four-pin electrical connector as set forth in claim 1, wherein:

each one of said plurality of terminal feeding devices comprises a terminal feeding rack, a terminal strip disc, a terminal transportation rail, said first motor, and a guide pulley;

wherein said terminal strip disc is mounted upon an output drive shaft of said first motor which is engaged with a central portion of terminal strip disc;

said terminal transportation rail is disposed beneath said terminal strip disc;

terminal transportation rail is provided a guide pulley; and said first motor is electrically connected to said power control box.

4. The automatic terminal fitting device fora four-pin electrical connector as set forth in claim 1, wherein a terminal strip bending device comprises:

a terminal strip bending seat;

a reject bin located adjacent to one end of said terminal strip bending seat;

a material bending fixing block mounted upon said terminal strip bending seat;

a material bending head having one end thereof mounted upon said material bending fixing block while an opposite end thereof is disposed above an upper end of said reject bin;

a second pushing plate operatively connected to said material bending fixing block;

a second cylinder operatively connected to said second pushing plate;

a lifting seat defined within said material bending fixing block;

a third rotating shaft disposed within said lifting seat;

a wave shaped bending slot is defined within said second pushing plate and within which said third rotating shaft is disposed, said lifting seat being vertically oriented within said material bending fixing block so as to slidably cooperate with said material bending fixing block and wherein said one end of said material bending head is mounted upon said lifting seat;

a material gripping tooth is mounted upon said opposite end of said material bending head which is disposed above said reject bin;

a discharging hole is defined within said opposite ends of said material bending head adjacent to said material gripping tooth such that said discharging hole is disposed above said reject bin so as to discharge rejected terminals into said reject bin; and said second cylinder is electrically connected to said power control box.

5. The automatic terminal fitting device for a four-pin electrical connector as set forth in claim 1, further comprising:

a riveting device having a riveting seat mounted upon said rack;

wherein said riveting device comprises:

a third pushing plate;

a third cylinder mounted upon a first end of said riveting seat and operatively connected to said third pushing plate;

a guiding seat mounted upon a second opposite end of said riveting seat;

a riveting head mounted upon said guiding seat;

said third pushing plate slidably cooperates with said guiding seat and to the front end of the third pushing plate is operatively connected said riveting head so as to insert four terminals within one of said rubber shells so as to form a four-pin electrical connector; and said third cylinder is electrically connected to said power control box.

6. The automatic terminal fitting device for a four-pin electrical connector as set forth in claim 1, wherein said back cover assembly device comprises:

a back cover assembly seat mounted upon said rack;

a back cover distribution block mounted atop said back cover assembly seat;

a fourth pushing plate having a first end mounted upon said back cover assembly seat and a second end slidably disposed within a slot defined within said back cover distribution block;

a back cover conveying rail disposed adjacent to said back cover assembly seat and operatively connected to said back cover vibration disc;

a baffle mounted upon said back cover assembly seat and disposed beneath said back cover distribution block;

a fourth cylinder disposed within a slot defined within said baffle and operatively cooperates with said back cover distribution block, and a fifth cylinder operatively connected to said fourth pushing plate;

and wherein both said fourth and fifth cylinders are electrically connected to said power control box.

* * * * *